US010780905B2

(12) United States Patent
Pinto et al.

(10) Patent No.: US 10,780,905 B2
(45) Date of Patent: Sep. 22, 2020

(54) POSITION DETERMINATION METHOD AND SYSTEM

(71) Applicant: Aktiebolaget SKF, Gothenburg (SE)

(72) Inventors: Elena Pinto, Alcorcón-Madrid (ES); Victor Martinez, Madrid (ES)

(73) Assignee: Aktiebolaget SKF, Gothenburg (SE)

( * ) Notice: Subject to any disclaimer, the term of this patent is extended or adjusted under 35 U.S.C. 154(b) by 174 days.

(21) Appl. No.: 16/057,862

(22) Filed: Aug. 8, 2018

(65) Prior Publication Data

US 2019/0084599 A1 Mar. 21, 2019

(30) Foreign Application Priority Data

Sep. 15, 2017 (EP) ..... 17380019

(51) Int. Cl.
*B61L 25/02* (2006.01)
*B61L 25/06* (2006.01)

(52) U.S. Cl.
CPC ..... *B61L 25/026* (2013.01); *B61L 25/021* (2013.01); *B61L 25/023* (2013.01); *B61L 25/06* (2013.01)

(58) Field of Classification Search
CPC ..... B61L 25/026
USPC ..... 701/445
See application file for complete search history.

(56) References Cited

U.S. PATENT DOCUMENTS 6,377,215 B1 4/2002 Halvorson
10,072,932 B2 * 9/2018 Cordova ..... G08G 1/123
2006/0151672 A1 * 7/2006 Heddebaut ..... B61L 3/125 246/121
2012/0136621 A1 5/2012 Inomata et al.
2013/0261856 A1 10/2013 Sharma et al.
2015/0181374 A1 * 6/2015 Tsuda ..... H04W 4/029 455/457
2016/0125054 A1 * 5/2016 Walker ..... G06F 16/29 707/722
2016/0325766 A1 * 11/2016 Tsujita ..... B61L 3/125

FOREIGN PATENT DOCUMENTS

AT 516553 A1 6/2016
EP 0231661 A2 8/1987
EP 1623905 A1 2/2006
WO 2016/139580 A1 9/2016

* cited by examiner

*Primary Examiner* — Jason C Olson
(74) *Attorney, Agent, or Firm* — Garcia-Zamor Intelletual Property Law; Ruy Garcia-Zamor; Bryan Peckjian

(57) ABSTRACT

A method of determining the geographical position of a rail vehicle travelling on a defined route that has a number of known stopping locations separated by known distances. The method comprises steps of: recording a linear speed signal of the vehicle; processing the linear speed signal to identify a plurality of preceding stationary periods when linear speed equals zero, including a last stationary period, and to calculate the distance traveled between the plurality of preceding stationary periods; comparing the calculated distances with the known distances between stopping locations, to match the last identified stationary period to a corresponding one of the known stopping locations and identify the direction of travel of the rail vehicle; and determining the geographical position of the rail vehicle by processing a portion of the speed signal obtained since the last identified stationary period, to calculate the distance traveled from the corresponding stopping location.

12 Claims, 2 Drawing Sheets

POSITION DETERMINATION METHOD AND SYSTEM

CROSS-REFERENCE

This application claims priority to European patent application no. 17380019.4 filed on Sep. 15, 2017, the contents of which are fully incorporated herein by reference.

TECHNOLOGICAL FIELD

The invention relates generally to the field of position determination and is more particular directed to a method and system for determining the geographic location of a rail vehicle.

BACKGROUND

Rail vehicles with on-board computers for position determination are well known in the art. Position determination may form part of an automatic train protection system, for example, to prevent collisions with other vehicles. Position determination is also used on vehicles with track monitoring equipment, so that identified defects in the track can be linked to a distance from a known reference point.

An example of a position determination system for a rail vehicle is disclosed in U.S. Pat. No. 6,377,215. The rail vehicle is equipped with a GPS receiver to provide "rough" positional information. For improved accuracy, to identify which track the vehicle is running on in the event that sections of different rail tracks are located close together, the system comprises means for detecting curved track sections and for detecting if the vehicle enters a track switch. Specifically, the vehicle has a pivotably coupled wheel truck and distance sensors mounted to the vehicle body at left and right sides thereof that measure the horizontal distance to the left and right front wheels respectively. When the vehicle is on a straight track section, the measured distances are substantially equal. When the wheel truck enters a curve or switch, the measured distances change. This information may then be used to accumulate data on the number, magnitude and sequence of curves and switches, to determine the rail vehicle's location relative to curves and switches defined in a rail track database.

In metro rail networks, where the rail vehicles mainly travel underground, it is not possible to use GPS.

The present invention seeks to address this problem and define a method and system for position determination that does not rely on GPS.

BRIEF SUMMARY OF THE PRESENT INVENTION

In a first aspect, the invention relates to a method of determining the geographical position of a rail vehicle travelling on a defined route that has a number of known stopping locations separated by known distances. The method comprises steps of:

- recording a linear speed signal of the vehicle;
- processing the speed signal to:
  - identify a plurality of preceding stationary periods when linear speed equals zero, including a last stationary period and;
  - calculate the distance traveled between the plurality of preceding stationary periods;
  - comparing the calculated distances with the known distances between stopping locations, to match the last identified stationary period to a corresponding one of the known stopping locations and identify the direction of travel of the rail vehicle; and
  - determining the geographical position of the rail vehicle by processing a portion of the speed signal recorded since the last identified stationary period, to calculate the distance traveled from the corresponding stopping location.

Suitably, the defined route is stored in a database, in which the position of each stopping location relative to a route start point is recorded, along with the distance traveled between successive stopping locations along the route. Typically, the stopping locations i.e. stations on an underground rail network are separated by distances of 500 m-2000 m. Depending on the size of the network, the database may contain several defined routes on which a rail vehicle operating on the network might travel.

In the method of the invention, a speed signal of the rail vehicle is measured and processed. The speed signal may be obtained from a wheel angular speed sensor (tachometer), whereby the diameter of the wheel is used to convert the angular speed to a linear speed of the vehicle. An optical velocity meter comprising a pick-up head mounted to the vehicle and a pair of light sources spaced in the direction of travel could also be employed. Furthermore, in applications where the routes on which a rail vehicle travels allow the use of GPS, the linear speed could be obtained from the GPS signal.

When the rail vehicle is stationary, speed is of course equal to zero, and it is most likely that an identified stationary period corresponds to the time spent at a station. During the step of processing, a number N of preceding stationary periods are identified from the speed signal. Between the stationary periods, the vehicle has made N−1 trips. The distance traveled during these N−1 trips is calculated by integrating the speed signal with respect to time.

In a next step, the N−1 calculated distances are compared with the known distances between stations stored in the database of defined route(s). Suitably, a pattern recognition algorithm is employed to identify a match between the sequence of calculated trip distances and a sequence of known distances within a defined route. As will be understood, the selected number N needs to be high enough to accurately identify a unique sequence within the defined routes. Depending on the network, five calculated trip distances may be sufficient, although this number can of course be higher.

When a match is found within a particular one of the one or more defined routes, the last identified stationary period within the speed signal is correlated to a corresponding stopping location within the particular route. The match will also identify the direction of travel, so that the next stopping location on the route is known.

In a final step, the current position of the vehicle is determined by integrating a portion of the speed signal obtained since the last stationary period, to calculate the distance traveled from the known position of the last stopping location.

In a second aspect, the invention relates to a position determination system for a rail vehicle comprising:

- a database of defined routes within a rail network, whereby each defined route has a number of scheduled stopping locations at known positions relative to a reference point; and
- a processor arranged to perform the method steps of the invention.

In an embodiment, the position determination system forms part of a track condition monitoring system, comprising one or more sensors for detecting defects in a top surface of the rails. Commonly, at least the vertical acceleration signal from an accelerometer mounted to e.g. an axle box at either side of one of the bogies is processed in order to identify the presence of a surface defect. Suitably, the position determination system is configured to perform the method of the invention at the time when the presence of a surface defect is identified from the processed signal.

The invention will now be described in more detail, with reference to the accompanying figures.

DETAILED DESCRIPTION OF THE PRESENT INVENTION

Figure 1:
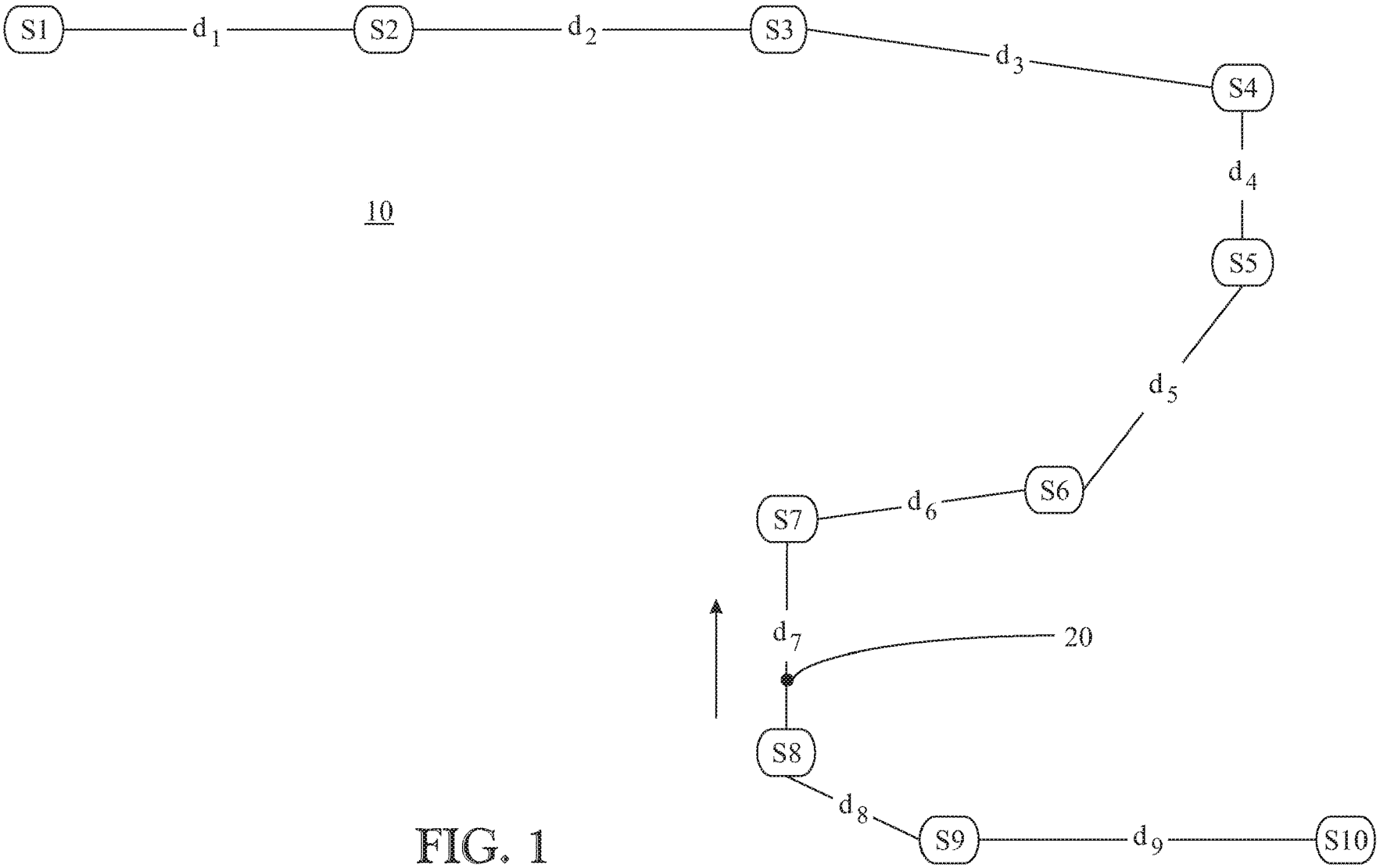
FIG. 1 presents a schematic representation of a metro line constituting a route traveled by a rail vehicle.

FIG. 1 is a schematic representation of a route 10 of an underground railway line having ten stations S1, S2, . . . S10. A rail vehicle 20 travels back and forth along the route between the stations S1 and S10. The vehicle is equipped with a position determination system, to enable its location on the route to be determined at any given time or continuously monitored. The system implements an inventive method of position determination, based on using the signal from an on-board speed sensor to calculate the distance traveled during a number of previous trips and matching the calculated distances to a stored map of the route.

A vehicle stopping point at station S1 is defined as the start of the route and is located at mile marker 0. The mile marker location of a vehicle stopping point at each subsequent station along the route is known, meaning that the corresponding distances d1, d2, . . . d9 between neighboring stations is also known. Assuming certain numerical values for the mile marker locations, the route of FIG. 1 can be represented in tabular form as follows:

TABLE 1

Example of a route comprising 10 stations and 18 stopping points

| Stop No. | Station | Mile Marker (in metres) | Distance from previous station (m) |
|---|---|---|---|
| 1 | S1 | 0 | 1050 ($d_1$) |
| 2 | S2 | 1050 | 1050 ($d_1$) |
| 3 | S3 | 2175 | 1125 ($d_2$) |
| 4 | S4 | 3450 | 1275 ($d_3$) |
| 5 | S5 | 4150 | 700 ($d_4$) |
| 6 | S6 | 5200 | 1050 ($d_5$) |
| 7 | S7 | 6100 | 900 ($d_6$) |
| 8 | S8 | 6900 | 800 ($d_7$) |
| 9 | S9 | 7650 | 750 ($d_8$) |
| 10 | S10 | 8800 | 1150 ($d_9$) |
| 11 | S9 | 7650 | 1150 ($d_9$) |
| 12 | S8 | 6900 | 750 ($d_8$) |
| 13 | S7 | 6100 | 800 ($d_7$) |
| 14 | S6 | 5200 | 900 ($d_6$) |
| 15 | S5 | 4150 | 1050 ($d_5$) |
| 16 | S4 | 3450 | 700 ($d_4$) |
| 17 | S3 | 2175 | 1275 ($d_3$) |
| 18 | S2 | 1050 | 1125 ($d_2$) |
| 1 | S1 | 0 | 1050 ($d_1$) |

The position determination system may be linked to a track condition monitoring system for detecting defects in a surface of the rails. In the depicted example, the rail vehicle 20 is provided with track monitoring equipment such as disclosed in U.S. Pat. No. 668,239. The equipment includes vertical acceleration sensors mounted at each side of a bogie of the rail vehicle, above a wheel set, and displacement transducers—one on each side of the bogie—arranged to monitor the distance between the bogie and the wheel. The sensor data is processed to calculate the magnitude of undulations in a top surface of the track.

Let us assume that an unacceptable value is calculated at a point in time when the vehicle 20 is travelling from station S8 to S7 as shown in FIG. 1. To enable a maintenance crew to be sent to the location of the track defect, the position determination system is configured to determine the position of the vehicle at the time when a track defect has been detected. In an embodiment, the position determination system implements the following method:

A linear speed signal of the vehicle is measured and recorded. This may be done using a tachometer, such as a magnetic pulse encoder attached to a wheel shaft or to a wheel bearing that supports the wheel shaft. A known value of the wheel diameter is then used to convert the angular speed in rotations per unit time to distance per unit time. Other methods of measuring linear speed may also be employed.

Figure 2:
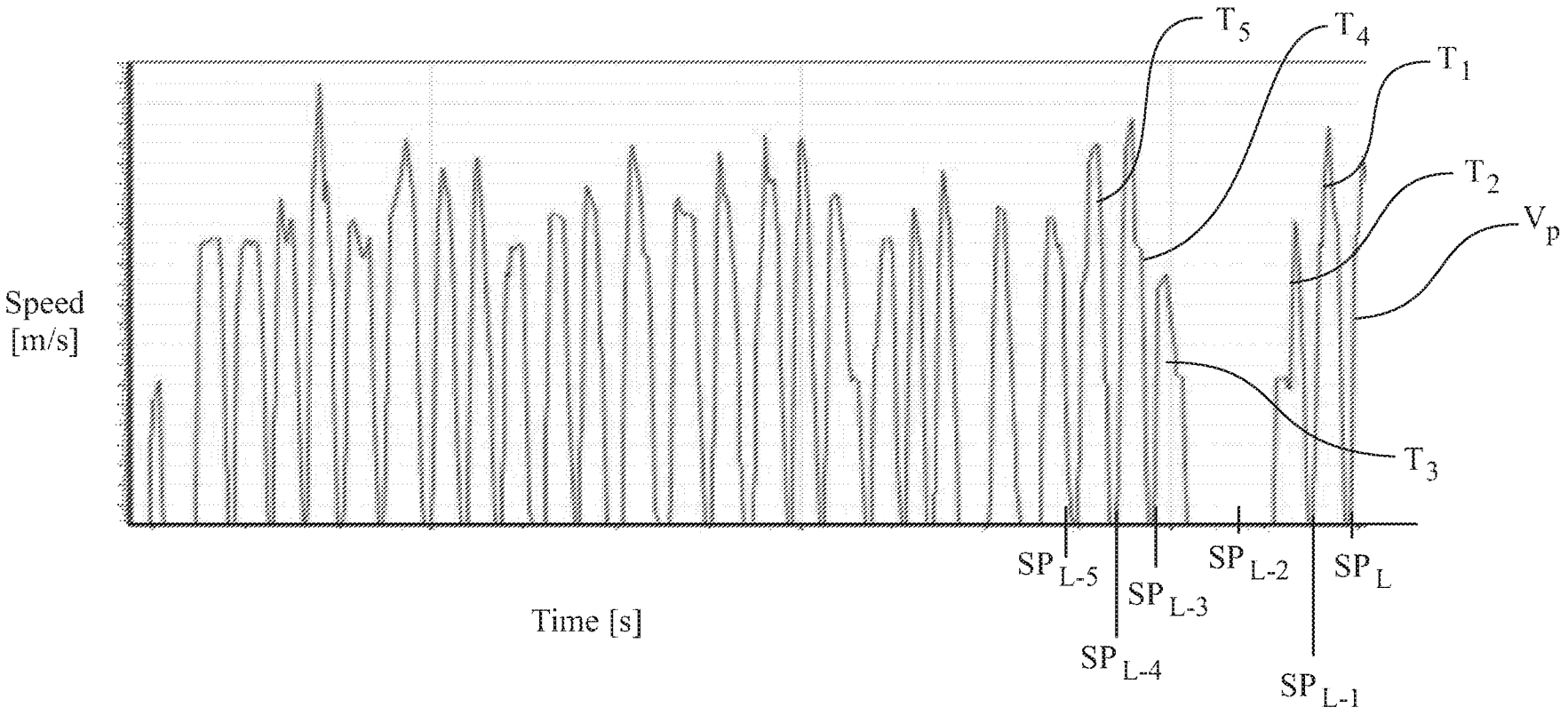
FIG. 2 presents a plot of a linear speed signal that could be measured for a rail vehicle travelling on the route depicted in FIG. 1.

An example of a speed signal that could be measured is shown in FIG. 2. The method comprises a step of processing the speed signal, firstly to identify a last stationary period SPL when the vehicle speed was equal to zero and a number of preceding stationary periods SPL-1, SPL-2, SPL-3, SPL-4, SPL-5. The speed signal between consecutive stationary periods corresponds to a number of previous trips T1, T2, T3, T4, T5.

The step of processing further comprises integrating the speed signal with respect to time, to obtain the distance traveled during each of the previous trips T1-T5. Let us assume that the following distances are calculated: 749 m, 1152 m, 1151 m, 753 m, 801 m.

In a next step, the calculated distances (+/− a certain allowable error of e.g. 6 m) are compared against the known distances between stations on the stored route, to identify which station corresponds to the last stationary period SPL and determine the direction of travel of the rail vehicle. Any suitable pattern recognition algorithm may be employed.

In the given example, a match is found between the calculated trip history and the distances highlighted in Table 1. The distance traveled to reach the last stopping location was approximately equal to 750 m. This trip distance on its own is not sufficient to determine which was the last station, given that this distance is traveled to reach stations S8 and S9, depending on the rail vehicle's direction of travel. Furthermore, in other examples of rail routes, the individual distances between stations may not be unique. At least the distance traveled in the preceding trip (approx. 1150 m) is needed in the present example in order to identify that station S8 was the last station and that the vehicle is travelling back to the start of the route. As will be understood, the number of trips included in the trip history is at least sufficient to enable a unique sequence to be identified within the route in question.

Preferably, a greater number of trips than the minimum number is included in the trip history, to improve accuracy and account for erroneous measurement results. For example, it the vehicle makes an unscheduled stop between stations within the calculated trip history, it is likely that the calculated distance traveled to reach that stopping location will not correspond to one of the values d1, d2, . . . d9 in the stored route. Or, if by coincidence it does correspond to a stored value, then the preceding or subsequent calculated distance will not.

The pattern recognition algorithm used in the step of comparing may be adapted to ignore a non-matching calculation result or sequence of results, and seek a match based on a smaller number of calculated distances. Additionally, the pattern recognition algorithm may be adapted to add non-matching calculation results and compare the sum with the stored distances, to find a match which identifies the last station and the direction travel.

In a final step, the location of the rail vehicle 20 is determined by calculating the distance traveled since the last station (S8 in the present example) using a portion of the speed signal Vp measured since the last identified stationary period SPL. Let us assume that integration of this signal portion Vp results in a distance of 350 m We know that the last station S8 is located at mile marker 6900 m and that the vehicle is travelling back towards the start of the route. The train positioning system thus determines that at the time of implementing the inventive method, i.e. at the time when a surface defect was detected, the rail vehicle's location is 6550 m from the zero mile marker. A maintenance crew can thus be sent to the right location in order to carry out necessary track repairs.

What is claimed is:

1. A method of determining the geographical position of a rail vehicle on a rail route having a number of known stopping locations that are separated by known distances, the method comprising steps of:

recording a linear speed signal of the vehicle; processing the linear speed signal to:

identify a plurality of preceding stationary periods when vehicle speed equals zero, including a last stationary period; and calculate the distance traveled between the plurality of preceding stationary periods;

comparing the calculated distances with the known distances between stopping locations, to find a matching sequence that correlates the last identified stationary period to a corresponding one of the known stopping locations and identifies the direction of travel of the rail vehicle; and determining the geographical position of the rail vehicle by processing a portion of the speed signal recorded since the last identified stationary period to calculate the distance traveled from the corresponding stopping location, completing at least one of the steps with a processor.

2. The method of claim 1, wherein a pattern recognition algorithm is used in the step of comparing.

3. The method of claim 2, wherein the linear speed signal is obtained by measuring a rotational speed of a vehicle wheel and using a known diameter of the wheel to obtain the linear speed of the rail vehicle.

4. The method of claim 1, wherein the linear speed signal is obtained by measuring a rotational speed of a vehicle wheel and using a known diameter of the wheel to obtain the linear speed of the rail vehicle.

5. A position determination system for a rail vehicle, the system comprising:

a database of defined routes within a rail network, each defined route having a number of scheduled stopping locations of known geographic position relative to a reference point; and a processor configured to receive a linear speed signal of the vehicle and to perform steps of recording a linear speed signal of the vehicle; processing the linear speed signal to:

identify a plurality of preceding stationary periods when vehicle speed equals zero, including a last stationary period; and calculate the distance traveled between the plurality of preceding stationary periods;

comparing the calculated distances with the known distances between stopping locations, to find a matching sequence that correlates the last identified stationary period to a corresponding one of the known stopping locations and identifies the direction of travel of the rail vehicle; and determining the geographical position of the rail vehicle by processing a portion of the speed signal recorded since the last identified stationary period to calculate the distance traveled from the corresponding stopping location.

6. A track condition monitoring system comprising:

a position determination system, providing a database of defined routes within a rail network, each defined route having a number of scheduled stopping locations of known geographic position relative to a reference point; and a processor configured to receive a linear speed signal of the vehicle and to perform steps of recording a linear speed signal of the vehicle; processing the linear speed signal to:

identify a plurality of preceding stationary periods when vehicle speed equals zero, including a last stationary period; and calculate the distance traveled between the plurality of preceding stationary periods;

comparing the calculated distances with the known distances between stopping locations, to find a matching sequence that correlates the last identified stationary period to a corresponding one of the known stopping locations and identifies the direction of travel of the rail vehicle; and determining the geographical position of the rail vehicle by processing a portion of the speed signal recorded since the last identified stationary period to calculate the distance traveled from the corresponding stopping location, one or more sensors mounted to a rail vehicle for detecting rail surface defects and a processor configured to analyze a signal from the one or more sensors and identify the presence of a surface defect, wherein the position determination system is configured to determine the position of the rail vehicle at the time when the presence of a surface defect is identified.

7. The track condition monitoring system comprising the position determination system of claim 6, wherein a pattern recognition algorithm is used in the step of comparing.

8. The track condition monitoring system comprising the position determination system of claim 7, the track condition monitoring system comprising one or more sensors mounted to a rail vehicle for detecting rail surface defects and a processor configured to analyze a signal from the one or more sensors and identify the presence of a surface defect, wherein the position determination system is configured to determine the position of the rail vehicle at the time when the presence of a surface defect is identified.

9. The track condition monitoring system comprising the position determination system of claim 7, wherein the linear speed signal is obtained by measuring a rotational speed of a vehicle wheel and using a known diameter of the wheel to obtain the linear speed of the rail vehicle.

10. The track condition monitoring system comprising the position determination system of claim 9, the track condition monitoring system comprising one or more sensors mounted to a rail vehicle for detecting rail surface defects and a processor configured to analyze a signal from the one or more sensors and identify the presence of a surface defect, wherein the position determination system is configured to determine the position of the rail vehicle at the time when the presence of a surface defect is identified.

11. The track condition monitoring system comprising the position determination system of claim 6, wherein the linear speed signal is obtained by measuring a rotational speed of a vehicle wheel and using a known diameter of the wheel to obtain the linear speed of the rail vehicle.

12. The track condition monitoring system comprising the position determination system of claim 11, the track condition monitoring system comprising one or more sensors mounted to a rail vehicle for detecting rail surface defects and a processor configured to analyze a signal from the one or more sensors and identify the presence of a surface defect, wherein the position determination system is configured to determine the position of the rail vehicle at the time when the presence of a surface defect is identified.

* * * * *